US008284181B2

(12) United States Patent
Nakao et al.

(10) Patent No.: US 8,284,181 B2
(45) **Date of Patent: *Oct. 9, 2012**

(54) DISPLAY DEVICE

(75) Inventors: Takayuki Nakao, Mobara (JP); Hideo Sato, Hitachi (JP); Masahiro Maki, Mobara (JP); Toshio Miyazawa, Chiba (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 294 days.

This patent is subject to a terminal disclaimer.

(21) Appl. No.: 12/684,317

(22) Filed: Jan. 8, 2010

(65) Prior Publication Data

US 2010/0171739 A1 Jul. 8, 2010

Related U.S. Application Data

(62) Division of application No. 11/384,363, filed on Mar. 21, 2006, now Pat. No. 7,724,231.

(30) Foreign Application Priority Data

Mar. 30, 2005 (JP) ..... 2005-096624

(51) Int. Cl.
*G09G 5/00* (2006.01)

(52) U.S. Cl. ..... 345/211; 345/204; 345/94; 345/92

(58) Field of Classification Search ..... 345/92–100, 345/204, 209, 211–215
See application file for complete search history.

(56) References Cited

U.S. PATENT DOCUMENTS

| | | | | |
|---|---|---|---|---|
| 5,537,129 | A * | 7/1996 | Okada et al. | 345/90 |
| 6,094,192 | A * | 7/2000 | Kobayashi et al. | 345/210 |
| 6,166,714 | A * | 12/2000 | Kishimoto | 345/96 |
| 6,320,566 | B1 * | 11/2001 | Go | 345/99 |
| 6,407,728 | B1 * | 6/2002 | Sekine | 345/90 |
| 7,271,792 | B2 * | 9/2007 | Kato | 345/98 |
| 7,319,452 | B2 * | 1/2008 | Moon | 345/100 |
| 7,528,826 | B2 * | 5/2009 | Lee et al. | 345/204 |
| 7,724,231 | B2 * | 5/2010 | Nakao et al. | 345/98 |
| 7,855,722 | B2 * | 12/2010 | Kim et al. | 345/211 |
| 2005/0088394 | A1 * | 4/2005 | Chung | 345/96 |
| 2005/0088395 | A1 * | 4/2005 | Chung | 345/98 |
| 2007/0001963 | A1 * | 1/2007 | Koma | 345/96 |

FOREIGN PATENT DOCUMENTS

JP 2001-194685 7/2001

* cited by examiner

*Primary Examiner* — Lun-Yi Lao
*Assistant Examiner* — Tom Sheng
(74) *Attorney, Agent, or Firm* — Antonelli, Terry, Stout & Kraus, LLP.

(57) ABSTRACT

The present invention provides a display device which includes a common electrode drive circuit having the single channel constitution which can miniaturize a circuit scale without increasing elements compared to a conventional display device. A display device includes a plurality of pixels and a common electrode drive circuit. The common electrode drive circuit includes a plurality of basic circuits, wherein the basic circuit includes a first circuit which latches a first input signal at a point of time that a clock signal is changed to a first voltage level from a second voltage level; a second circuit which latches a second input signal at the point of time that the clock signal is changed to the first voltage level from the second voltage level; a first switching circuit which is turned on based on the first circuit and a second switching circuit which is turned on based on the voltage second circuit.

4 Claims, 12 Drawing Sheets

DISPLAY DEVICE

This application is a divisional application of U.S. application Ser. No. 11/384,363, filed Mar. 21, 2006 now U.S. Pat. No. 7,724,231 and which application claims priority from Japanese application JP2005-096624 filed on Mar. 30, 2005, the contents of which are hereby incorporated by reference into this application.

BACKGROUND OF THE INVENTION

1. Field of the Invention

The present invention relates to a display device, and more particularly to a display device which includes a common electrode drive circuit adopting an every-line-independent common AC drive method.

2. Description of the Related Art

A liquid crystal display module adopting a TFT (Thin Film Transistor) system has been popularly used as a display device of a portable equipment such as a notebook-type personal computer. Particularly, a liquid crystal display module which includes a miniaturized liquid crystal display panel is used as a display device of a portable equipment such as a mobile phone which a user always carries with him/her, for example.

In general, when the same voltage (DC voltage) is applied to a liquid crystal layer for a long time, the tilting of the liquid crystal layer is fixed and, eventually, an image retention phenomenon is induced thus shortening a lifetime of the liquid crystal layer.

To prevent such a drawback, in the liquid crystal display module, the voltage applied to the liquid crystal layer is alternated for every fixed time. That is, using a voltage applied to a common electrode as the reference, the voltage applied to pixel electrodes is changed to a positive voltage side and a negative voltage side for every fixed time.

As a drive method for applying the AC voltage to the liquid crystal layer, there has been known a common inversion method which inverts a voltage applied to a common electrode to two potentials, that is, the potential at a high potential side and a potential at a low potential side. As one such common inversion method, a drive method which independently alternates a voltage applied to the common electrode for every line (also referred to as an every-line independent common AC drive method) is described in JP-A-2001-194685 (patent document 1) which is a document related to the present invention.

The every-line independent common AC drive method described in the above-mentioned patent document 1 uses an IPS (In Plane Switching) liquid crystal display panel, wherein the voltage applied to the common electrodes on respective display lines is independently alternated for respective lines. According to the drive method of the present invention, it is possible to decrease a voltage width of a gate voltage supplied to scanning lines.

SUMMARY OF THE INVENTION

In the above-mentioned patent document 1, as a common electrode drive circuit for driving the common electrode using the every-line independent common AC drive method, a drive circuit which is constituted of a CMOS circuit is described. However, the CMOS circuit has a drawback that a manufacturing process is increased.

To overcome this drawback, it may be possible to constitute the common electrode drive circuit which drives the common electrode by the above-mentioned every-line independent common AC drive method using a single channel circuit.

FIG. 18 is a circuit diagram showing the common electrode drive circuit having the single channel circuit constitution for driving the common electrode by the every-line independent common AC drive method which is conceived by inventors of the present invention prior to the present invention. The common electrode drive circuit which is shown in FIG. 18 is a drive circuit which uses an n-MOS transistor as transistors, and FIG. 19 is a timing chart of the common electrode drive circuit shown in FIG. 18.

The common electrode drive circuit shown in FIG. 18 includes a plurality of basic circuits, wherein the basic circuits latch an AC signal (V) by a transistor (T1) and latch an inverted AC signal (MB) by a transistor (T2) at a point of time that a scanning line selection signal is changed to a Low level (hereinafter referred to as "L level") from a High level (hereinafter referred to as "H level").

Here, as shown in FIG. 19, the AC signal (M) and the inverted AC signal (MB) have respective phases thereof made different from each other by 180° and hence, when one node out of a node (ND1) and a node (ND2) assumes the H level, another node inevitably assumes the L level.

By allowing the transistor (T3) or the transistor (T4) to assume the ON state when the node assumes the H level, when the node (ND1) assumes the H level, a positive-polarity common voltage (VCOMH) is outputted to an output (OUT), while when the node (ND2) assumes the H level, a negative-polarity common voltage (VCOML) is outputted to an output terminal (OUT).

Hereinafter, the manner of operation of the common electrode drive circuit shown in FIG. 18 is explained in detail in conjunction with a timing chart shown in FIG. 19.

(1) When a scanning line selection signal (SR(n−2)) which precedes a scanning line selection signal (SR(n)) by two stages assumes an H level, the transistors (T21, T22) are turned on, and nodes (ND1, ND2) are reset, that is, assume an L level.

In the same manner, when a scanning line selection signal (SR(n−2)) of the two preceding stage assumes an H level, the transistors (T23, T24) are turned on, and nodes (ND4, ND5) are reset.

(2) When a scanning line selection signal (SR(n−1)) which precedes the scanning line selection signal (SR(n)) by one stage assumes an H level, the transistors (T1, T2) are turned on and voltage levels of an AC signal (M) and an inverted AC signal (MB) are latched at the nodes (ND1, ND2).

In the same manner, when the one-stage-preceding scanning line selection signal (SR(n−1)) assumes an H level, the transistors (T7, T8) are turned on and nodes (ND4, ND5) are reset.

(3) When the scanning line selection signal (SR(n)) assumes an H level, due to a bootstrap effect attributed to the transistors (T5, T6) and capacitive elements (Cbs1, Cbs2), when the preceding-stage scanning line selection signal (SR (n−1)) assumes an H level, a voltage of the node (ND1 or ND2) which is raised to the H level is further raised.

Due to such an operation, it is possible to perform the AC driving of the plurality of common electrodes independently for every line.

Here, in the circuit shown in FIG. 18, the capacitive elements (Cs1, Cs2) are load capacitive elements for stabilizing the nodes (ND1, ND2) and transistors (T9, T10) are transistors for allowing another electrode to assume an L level when one node assumes an H level with respect to the nodes (ND1, ND2).

However, the above-mentioned common electrode drive circuit shown in FIG. 18 requires transistors (T21 to T24) for resetting the nodes and hence, there arises a drawback that the number of transistors which constitute the circuit is increased and, at the same time, the circuit constitution becomes complicated.

The present invention has been made to overcome the above-mentioned drawbacks of the related art and it is an advantage of the present invention to provide a display device including a common electrode drive circuit having a single channel constitution which can prevent the increase of the number of elements and can reduce a circuit scale compared to a display device of the related art.

The above-mentioned and other advantages and novel features of the present invention will become apparent by the description of this specification and attached drawings.

To briefly explain the summary of typical invention among the inventions disclosed in this specification, it is as follows.

To obtain the above-mentioned advantages of the present invention, according to the present invention, in a display device which includes a plurality of pixels and a common electrode drive circuit, wherein the common electrode drive circuit includes a plurality of basic circuits, and the basic circuit includes a first circuit which latches a first input signal at a point of time that a clock signal is changed to a first voltage level from a second voltage level, a second circuit which latches a second input signal at the point of time that the clock signal is changed to the first voltage level from the second voltage level, a first switching circuit which is turned on based on the voltage latched by the first circuit and outputs a first power source voltage to an output terminal in an ON state, and a second switching circuit which is turned on based on the voltage which is latched by the second circuit and outputs a second power source voltage to an output terminal in an ON state, the improvement is characterized in that when the first input signal assumes the second voltage level, the second input signal assumes the first voltage level, and when the second input signal assumes the second voltage level, the first input signal assumes the first voltage level, and after the clock signal is changed to the second voltage level from the first voltage level and before the clock signal returns to the first voltage level from the second voltage level, either one of the first input signal and the second input signal is changed to the second voltage level from the first voltage level.

To briefly explain advantageous effects obtained by the typical invention among the inventions disclosed in this specification, they are as follows.

According to the present invention, it is possible to provide the display device which includes the common electrode drive circuit having the single channel constitution which can prevent the increase of the number of elements and also can reduce the circuit scale compared to the display device of the related art.

DESCRIPTION OF THE PREFERRED EMBODIMENTS

Hereinafter, embodiments in which the present invention is applied to an active matrix-type liquid crystal display device are explained in detail in conjunction with drawings.

Here, in all drawings for explaining the embodiments, same symbols are given to parts having identical functions and their repeated explanation is committed.

Figure 1:
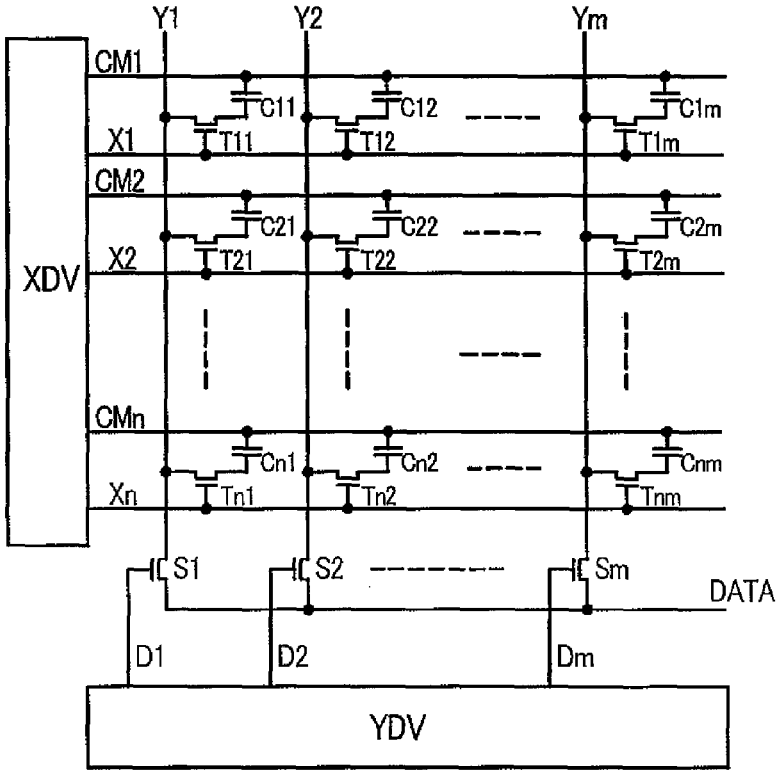
FIG. 1 is a circuit diagram showing an equivalent circuit of an active matrix type liquid crystal display device of an embodiment of the present invention.

FIG. 1 is a circuit diagram showing an equivalent circuit of the active matrix type liquid crystal display device of the embodiment of the present invention.

As shown in FIG. 1, the active matrix type liquid crystal display device of this embodiment is an active matrix type liquid crystal display device which uses an IPS (In Plane Switching) liquid crystal display panel, wherein on a liquid crystal surface of one substrate out of a pair of substrates which are arranged to face each other with liquid crystal therebetween, n pieces of gate lines (X1, X2, . . . , Xn) which extend in the x direction, n pieces of common lines (CM1, CM2, . . . , CMn) which extend in the x direction, and m pieces of drain lines (Y1, Y2, . . . , Ym) which extend in the y direction which intersects the x direction are formed.

Regions which are surrounded by the gate lines (also referred to as scanning lines) and the drain lines (also referred to as video lines) constitute pixel regions, wherein each pixel region includes a thin film transistor (Tnm) which has a gate thereof connected to the gate line, a drain (or a source) thereof connected to the drain line, and a source (or a drain) connected to a pixel electrode. Further, a liquid crystal capacitance (Cnm) is provided between the pixel electrode and the common line.

Here, although a holding capacitance is provided between the pixel electrode and the common line (CM1, CM2, . . . , CMn), the illustration of the holding capacitance is omitted in FIG. 1.

The respective gate lines (X1, X2, . . . , Xn) are connected to a vertical drive circuit (XDV) and a gate signal is sequentially supplied to the gate lines X1 to Xn from the vertical drive circuit (XDV).

The respective common lines (CM1, CM2, . . . , CMn) are connected to the vertical drive circuit (XDV), wherein a voltage which is applied to the common lines CM1 to CMn from the vertical drive circuit (XDV) at the same timing as the gate signal is subject to the AC driving by sequentially changing polarities.

The respective drain lines (Y1, Y2, . . . , Ym) are connected to the drains (or sources) of the switching elements (S1, S2, . . . , Sm).

The switching elements (S1, S2, . . . , Sm) have sources (or drains) thereof connected to video signal lines (DATA) and gates thereof connected to a horizontal drive circuit (YDV), while the horizontal drive circuit (YDV) sequentially scans the switching elements S1 to Sm.

The present invention relates to a common electrode drive circuit in the inside of the vertical drive circuit (XDV).

Figure 2A:
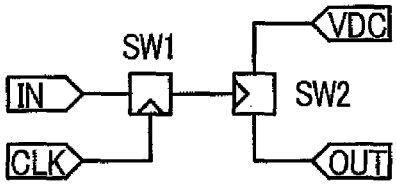
FIG. 2A is a circuit diagram for explaining a principle of a common electrode drive circuit of the present invention.

In the present invention, two switching elements SW1, SW2 are constituted as shown in FIG. 2A.

In a state that an n MOS-TFT (an n-type MOS thin film transistor) is used as the switching elements (SW1, SW2), when a clock signal (CLK) is changed over from an H level to an L level, the switching element (SW1) latches a voltage of an input signal (IN).

The latched voltage is held when the clock signal (CLK) assumes the L level, while when the latched voltage assumes the H level, the switching element (SW2) assumes an ON state and a voltage of VDC is supplied as an output (OUT).

Figure 2B:
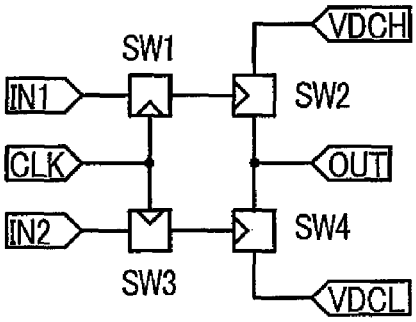
FIG. 2B is a circuit diagram for explaining a principle of a common electrode drive circuit of the present invention.

The common electrode drive circuit of the present invention, as shown in FIG. 2B, adopts a circuit which is formed by combining two circuit constitutions shown in FIG. 2A as the basic constitution. However, it is prohibited that in a state that the clock (CLK) assumes the H level, the first input signal (IN1) and the second input signal (IN2) assume the H level simultaneously.

Figure 3:
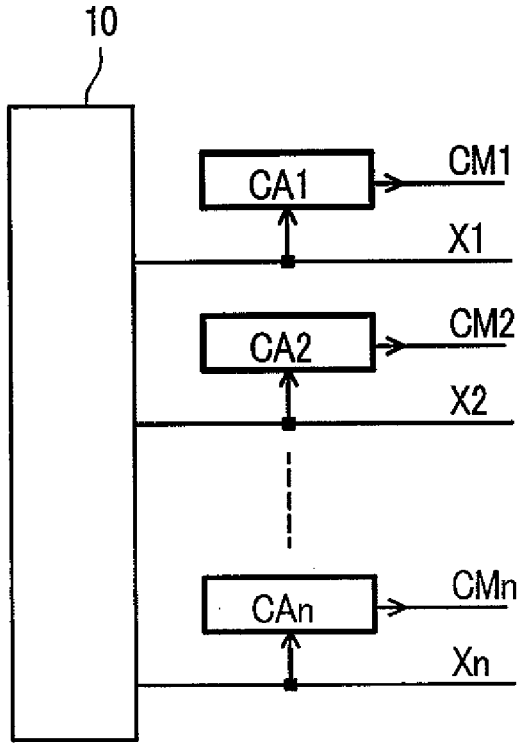
FIG. 3 is a block diagram showing the internal constitution of one example of a vertical drive circuit shown in FIG. 1.

FIG. 3 is a block diagram showing the internal constitution of the vertical drive circuit (XDV) shown in FIG. 1. In the drawing, numeral 10 indicates a scanning line drive circuit, and symbols CA1, CA2, . . . , CAn indicate the common electrode drive circuits.

As shown in FIG. 3, the common electrode drive circuits (CA1, CA2, . . . , CAn) of the present invention are provided for every gate line.

Figure 4:
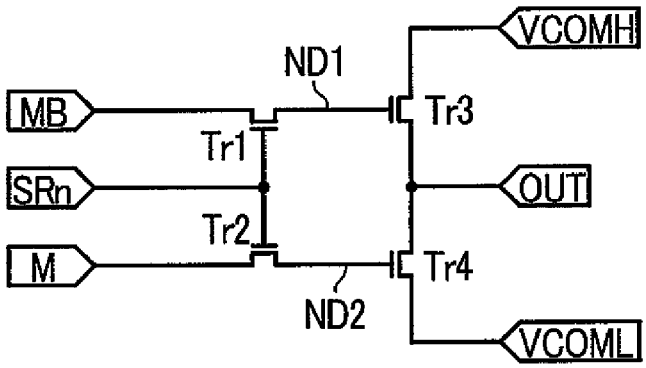
FIG. 4 is a circuit diagram showing a basic circuit of the common electrode drive circuit of the embodiment of the present invention.

FIG. 4 is a circuit diagram showing a basic circuit of the common electrode drive circuit (CA1, CA2, . . . , CAn) of this embodiment, wherein the circuit shown in FIG. 2B is constituted using the nMOS-TFTs.

In FIG. 4, symbol SRn indicates an nth scanning line selection signal which is outputted from the scanning line drive circuit 10, while symbols M and MB indicate AC signals. Further, symbol VCOMH indicates a common voltage having positive polarity which is supplied to the common lines, while symbol VCOML indicates a common voltage having negative polarity which is supplied to the common lines.

The H level of the AC signals (M, MB) and the scanning line selection signal (SRn) is higher than the common voltage (VCOMH) having the positive polarity, while the L level of the AC signals (M, MB) and the scanning line selection signal (SRn) is set lower than the common voltage (VCOML) having the negative polarity.

Accordingly, when the scanning line selection signal (SRn) assumes the H level, the AC signal (M) assumes the L level, and the AC signal (MB) assumes the H level, the node (ND1) assumes the H level and the node (ND2) assumes the L level and this state is held for one frame period and hence, as an output (OUT), the common voltage (VCOMH) having the positive polarity is outputted for one frame period.

Further, when the scanning line selection signal (SRn) assumes the H level, the AC signal (M) assumes the H level, and the AC signal (MB) assumes the L level, the node (ND1) assumes the L level and the node (ND2) assumes the H level and this state is held for one frame period and hence, as the output (OUT), the common voltage (VCOML) having the negative polarity is outputted for one frame period and hence, it is possible to alternate the common voltage applied to the common lines respectively.

Then, by providing the common electrode drive circuit (CA1, CA2, . . . , CAn) for every gate line as shown in FIG. 3, it is possible to perform the alternating by independently setting the common voltages applied to the respective common lines at the timing of gate-line writing.

Here, the constitution shown in FIG. 4 is configured such that when the AC signal (M) assumes the H level, the output (OUT) assumes the common voltage (VCOML) having the negative polarity and hence, the positive writing is performed with respect to the liquid crystal. However, depending on the writing constitution, the AC signals M, MB may be exchanged or the common voltages VCOMH, VCOML may be exchanged.

In the common electrode drive circuit (CA1, CA2, . . . , CAn) shown in FIG. 4, although the alternating is performed by changing over the states of the node (ND1) and the node (ND2), when the node (ND1) is changed over from the H level to the L level and the node (ND2) is changed over from the L level to the H level, or when the node (ND1) and the node (ND2) are changed in a reverse manner, at a moment that the changeover is performed, there exists a possibility that a time during which both of the node (ND1) and the node (ND2) assume the H level exists.

That is, there exists the possibility that both of the transistor (Tr3) and the transistor (Tr4) assume an ON state simultaneously. In this case, a terminal to which the common voltage (VCOMH) having the positive polarity is supplied and a terminal to which the common voltage (VCOML) having the negative polarity is supplied are directly connected and a through-current flows.

Figure 5:
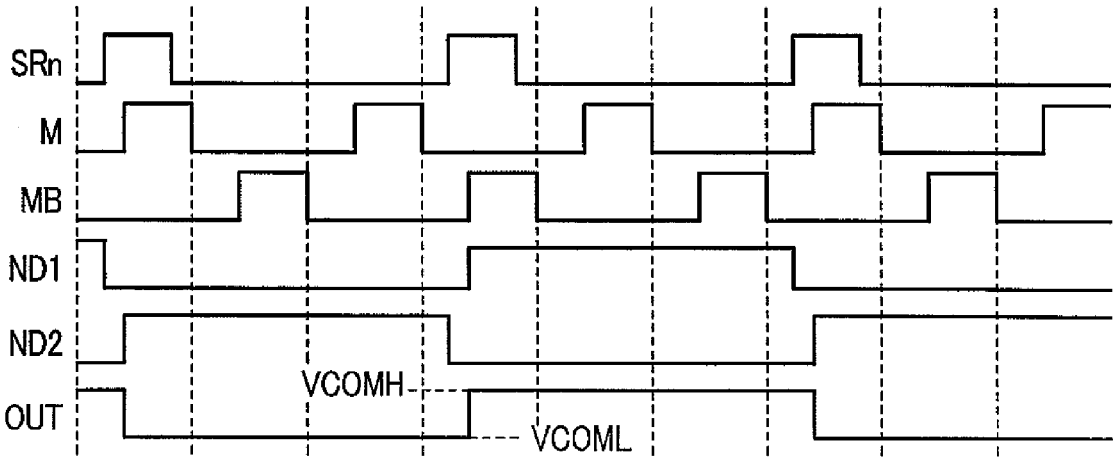
FIG. 5 is a timing chart of the common electrode drive circuit shown in FIG. 4.

Accordingly, clock signals having timings indicated in a timing chart shown in FIG. 5 are inputted as the scanning line selection signal (SRn) and the AC signals (M, MB).

That is, when the scanning line selection signal (SRn) assumes the H level, by establishing the timing relationship in which both of the AC signals (M, MB) assume the L level in an initial certain period, it is possible to allow the node (ND1) and the node (ND2) shown in FIG. 4 to assume the L level and hence, it is possible to allow the transistor (Tr3) and the transistor (Tr4) to assume the OFF state.

Thereafter, by allowing the AC signal (M) or the AC signal (MB) to assume the H level, it is possible to allow either one of the transistor (Tr3) or the transistor (Tr4) to assume the ON state and hence, it is possible to safely change over the common voltage applied to the common line.

Here, in FIG. 5, it is desirable that the falling of the scanning line selection signal (SRn) comes earlier than the falling of the AC signals (M, MB). When the falling of the scanning line selection signal (SRn) comes simultaneously with or after the falling of the AC signals (M, MB), there exists a possibility that both of the nodes (ND1, ND2) assume the L level when the scanning line selection signal (SRn) falls. Even in such a case, since the output (OUT) is held, there exists no trouble in performing the operation. However, so long as both of the nodes (ND1, ND2) are held at the L level, the output (OUT) is liable to easily fluctuate. Then, by allowing the falling of the scanning line selection signal (SRn) to come earlier than the falling of the AC signals (M, MB), it is possible to allow only one of the nodes (ND1, ND2) to assume the H level. Accordingly, it is possible to stabilize the output (OUT).

The node (ND1) and the node (ND2) are formed of a floating node. To allow the transistors (Tr3, or Tr4) which supply the common voltage to assume an ON state for a fixed period, it is necessary to hold the H level of the node (ND1) or the node (ND2).

Figure 6:
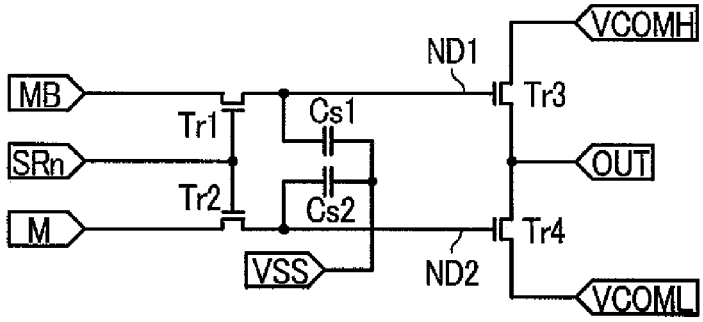
FIG. 6 is a circuit diagram showing a modification of the common electrode drive circuit shown in FIG. 4.

Accordingly, as shown in FIG. 6, by connecting the holding capacitances (Cs1, Cs2) between the node (ND1, ND2) (or the drain of the transistors (Tr1, Tr2)) and a reference power source line to which a reference voltage (VSS) is supplied, it is possible to stabilize the voltages of the nodes (ND1, ND2).

As described previously, when the node (ND1) and the node (ND2) assume the H level simultaneously, the through-current flows between the terminal to which the common voltage (VCOMH) having the positive polarity is supplied and the terminal to which the common voltage (VCOML) having the negative polarity is supplied.

Since the node (ND1) or the node (ND2) is formed of the floating node, the node (ND1) or the node (ND2) is liable to be easily influenced by noises. By adopting the circuit constitution shown in FIG. 6, it is possible to reduce the influence with respect to the noises. However, once the voltage is fluctuated, this effect is lost.

Figure 7:
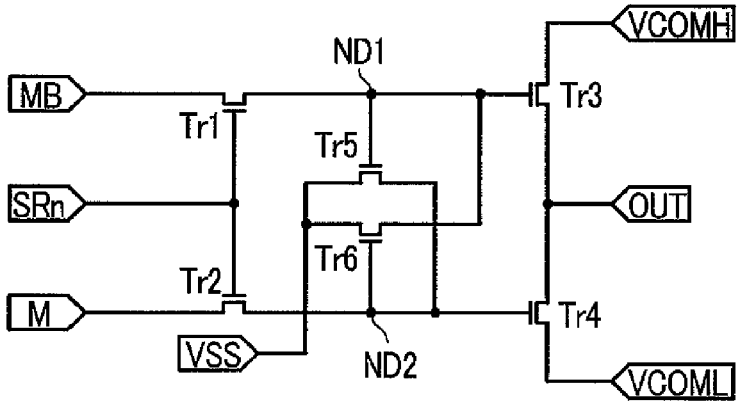
FIG. 7 is a circuit diagram showing a modification of the common electrode drive circuit shown in FIG. 4.

Accordingly, as shown in FIG. 7, by arranging the transistor (Tr5) and the transistor (Tr6) orthogonally, when one of the node (ND1) and the node (ND2) assumes the H level, it is possible to allow another one of the node (ND1) and the node (ND2) to always assume the L level. However, the reference voltage (VSS) is a voltage which corresponds to the L level of the AC signals (M, MB).

In such a constitution, when the node (ND1) and the node (ND2) simultaneously assume the H level, the through-current flows from the terminal to which the AC signal (MB) is supplied by way of the transistor (Tr1) and the transistor (Tr6) or the through-current flows from the terminal to which the AC signal (M) is supplied by way of the transistor (Tr2) and the transistor (Tr5) and hence, the timing relationship shown in FIG. 5 is effective in the changeover of the states of the node (ND1) and the node (ND2).

In the circuit constitution shown in FIG. 4, in fetching the H level of the AC signal (MB) to the node (ND1), in an actual operation, a voltage which is lowered from the H level of the AC signal (MB) by a threshold value voltage (Vth) is written in the node (ND1).

Further, with respect to the H level of the output (OUT) (the H level of the common voltage (VCOMH) having the positive polarity which is applied to the common lines), a voltage which is lowered from the voltage of H level of the node (ND1) by the threshold value voltage (Vth) becomes maximum.

Accordingly, as the H level of the AC signals (M, MB), even as a minimum level, a voltage which is obtained by adding a voltage twice as large as the threshold value voltage (Vth) to the H level of the common voltage (VCOMH) having the positive polarity applied to the common line becomes necessary.

In an actual operation, in a holding state, it is considered that a voltage which is sufficiently higher than the above-mentioned voltage becomes necessary in view of the voltage drop due to drawbacks on the voltage drop attributed to the decrease of charge or writing characteristics.

Figure 8:
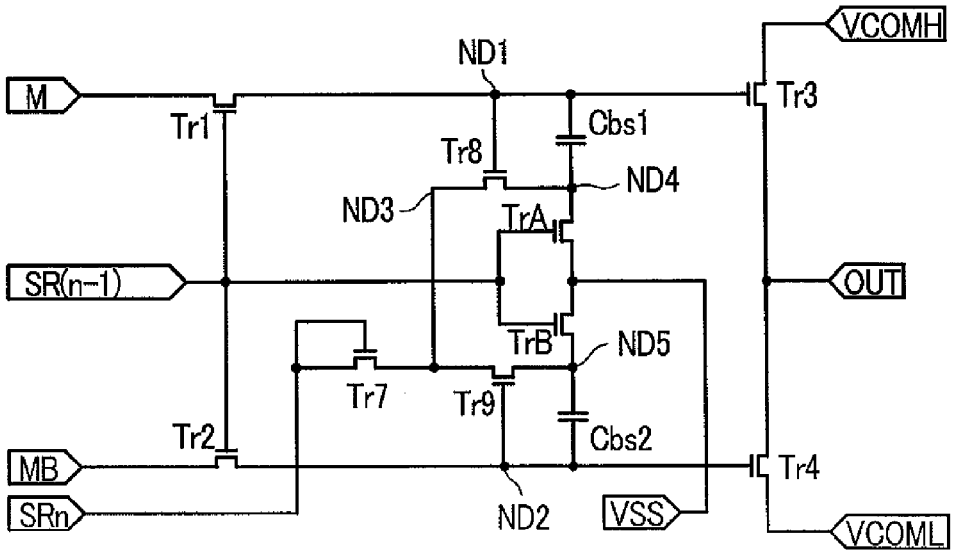
FIG. 8 is a circuit diagram showing a modification of the common electrode drive circuit shown in FIG. 4.

Accordingly, a common electrode drive circuit which includes a booster circuit using a bootstrap effect is shown in FIG. 8. Further, FIG. 9 is a timing chart of the common electrode drive circuit shown in FIG. 8.

In FIG. 8, symbol SR(n−1) indicates a scanning line selection signal which precedes an nth scanning line selection signal (SRn) and the scanning line selection signal (SR(n−1)) is outputted from the scanning line drive circuit 10 shown in FIG. 3.

Figure 9:
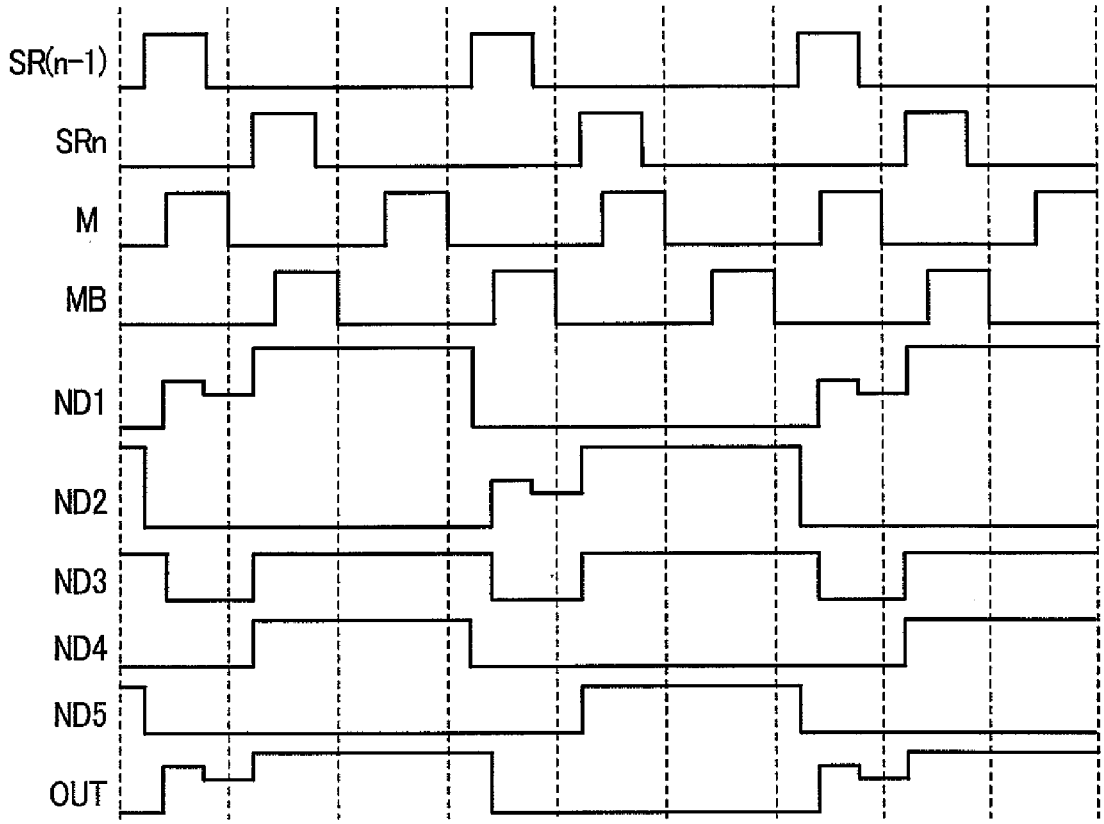
FIG. 9 is a timing chart of the common electrode drive circuit shown in FIG. 8.

The manner of operation of the common electrode drive circuit shown in FIG. 8 is simply explained using a timing chart shown in FIG. 9.

The scanning line selection signal (SR(n−1)) of the preceding stage assumes the H level, and the L level is once fetched in the node (ND1) and the node (ND2) thus performing the resetting. Thereafter, the state of the AC signal (M, MB) is fetched and, at the same time, the transistor (TrA) and the transistor (TrB) are turned on and hence, the voltages of the node (ND4) and the node (ND5) become the reference voltage (VSS). Accordingly, the voltage of the AC signal (M, MB) is charged in the capacitive element (Cbs1) and the capacitive element (Cbs2).

In such a state, the scanning line selection signal (SR(n−1)) of the preceding stage assumes the L level, and the node (ND1), the node (ND2), the node (ND4) and the node (ND5) assume a voltage holding state.

Next, when the nth scanning line selection signal (SRn) assumes the H level, the H level (the voltage which falls by the threshold value voltage (Vth) in an actual operation) is written in the node (ND3) through the transistor (Tr7) which is subjected to the diode connection.

Here, when the node (ND1) assumes the H level and the node (ND2) assumes the L level, the transistor (Tr8) is turned on and the transistor (Tr9) is turned off and hence, the node (ND5) is held at the L level and the H level is written only in the node (ND4).

Accordingly, the voltage of the node (ND1) is elevated due to a bootstrap effect through the capacitive element (Cbs1). Due to the voltage elevation of the node (ND1), the transistor (Tr8) is completely turned on and hence, the voltage of the node (ND1) is elevated by a voltage which is obtained by subtracting the threshold value voltage (Vth) from the H level of the nth scanning line selection signal (SRn) at maximum.

Since the node (ND5) is not fluctuated, the node (ND2) receives no voltage fluctuation and is held at the L level.

Here, it is possible to omit the transistors (Tr9, TrB) and the capacitive element (Cbs2) on the node (ND2) side which control the transistor (Tr4) which outputs the common voltage (VCOML) of the negative polarity to the output (OUT).

The node (ND1), the node (ND2), the node (ND4) and the node (ND5) are formed of a floating node. Accordingly, the node (ND1) and the node (ND2) are directly influenced by the voltage fluctuation of the node (ND4) and the node (ND5) through the capacitive elements (Cbs1, Cbs2).

Figure 10:
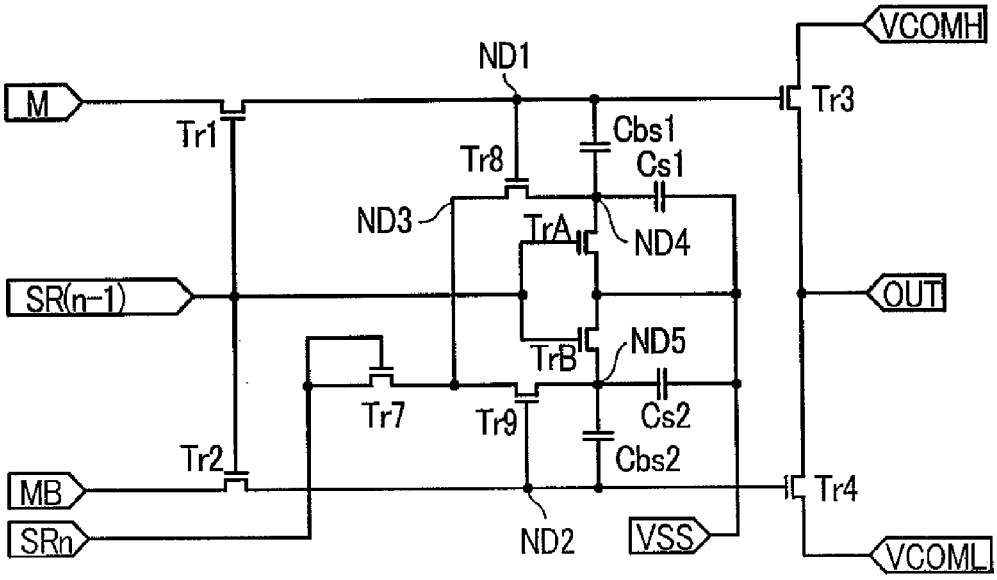
FIG. 10 is a circuit diagram showing a modification of the common electrode drive circuit shown in FIG. 8.

Accordingly, as shown in FIG. 10, by connecting load capacitances (Cs1, Cs2) between the nodes (ND4, ND5) (or drains of the transistors (Tr8, Tr9)) and a reference power source line through which the reference voltage (VSS) is supplied, it is possible to stabilize the voltages of the nodes (ND1, ND2). Here, the load capacitance (Cs2) may be omitted.

In the common electrode drive circuit shown in FIG. 8, when the scanning line selection signal (SR(n−1)) of the preceding stage assumes the H level, the voltages of the AC signals (M, MB) are written in the node (ND1) and the node (ND2), and the voltages of the node (ND4) and the node (ND5) assume the reference voltage (VSS).

The scanning line selection signal (SR(n−1)) of the preceding stage is outputted from the scanning line drive circuit 10 shown in FIG. 3. Since the output of the scanning line drive circuit 10 is connected to the gate lines (X1, X2, . . . , Xn), the output of the scanning line drive circuit 10 is liable to be influenced by the voltage fluctuation of the drain lines (Y1, Y2, . . . , Ym).

When the voltage of the output node of the scanning line drive circuit 10 instantaneously rises due to the influence of the voltage fluctuation, there exists a possibility that the transistor (Tr1), the transistor (Tr2), the transistor (TrA) and the transistor (TrB) are turned on.

Further, since the node (ND1), the node (ND2), the node (ND4) and the node (ND5) are formed of a floating node, these nodes are liable to be easily influenced by noises and hence, due to the above-mentioned voltage fluctuation or by being repeatedly influenced by the voltage fluctuation, there exists a possibility that the holding charge is lost thus leading to an erroneous operation.

Figure 11:
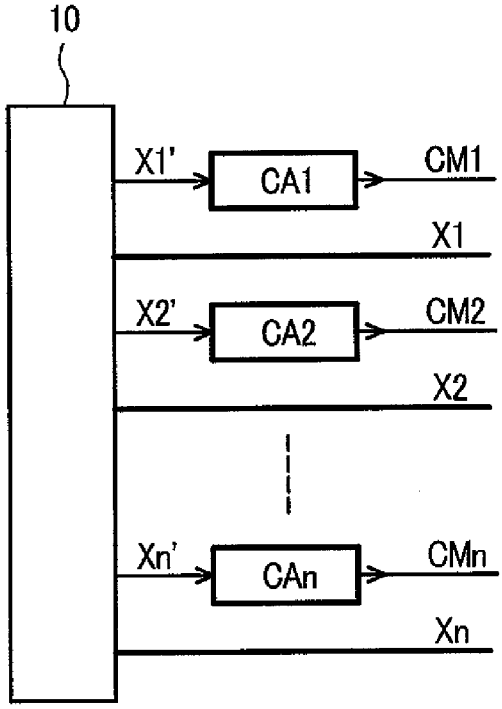
FIG. 11 is a block diagram showing the internal constitution of another example of the vertical drive circuit shown in FIG. 1.

Accordingly, as shown in FIG. 11, the output terminal of the scanning line drive circuit 10 is divided into terminals X1', X2', . . . , Xn', and these output terminals X1', X2', . . . , Xn' are made independent from the gate lines (X1, X2, . . . , Xn) thus allowing the node (ND1), the node (ND2), the node (ND4) and the node (ND5) to be hardly influenced by the voltage fluctuation whereby the erroneous operation can be suppressed.

Here, with respect to the terminal to which the nth scanning line selection signal (SRn) is supplied, the node (ND3) assumes the H level in a steady state and hence, the node (ND3) is hardly influenced by the voltage fluctuation of the terminal to which the nth scanning line selection signal (SRn) is supplied by the transistor (Tr7) whereby there may exist no problems.

In the common electrode drive circuit shown in FIG. 8, the voltages of the node (ND1) and the node (ND2) assume a voltage higher than the H level of the AC signals (M, MB) due to a bootstrap effect. Accordingly, the high voltage difference is generated between the source and the drain of the transistor (Tr1) and the transistor (Tr2) and hence, there arises a drawback with respect to a breakdown strength.

Figure 12:
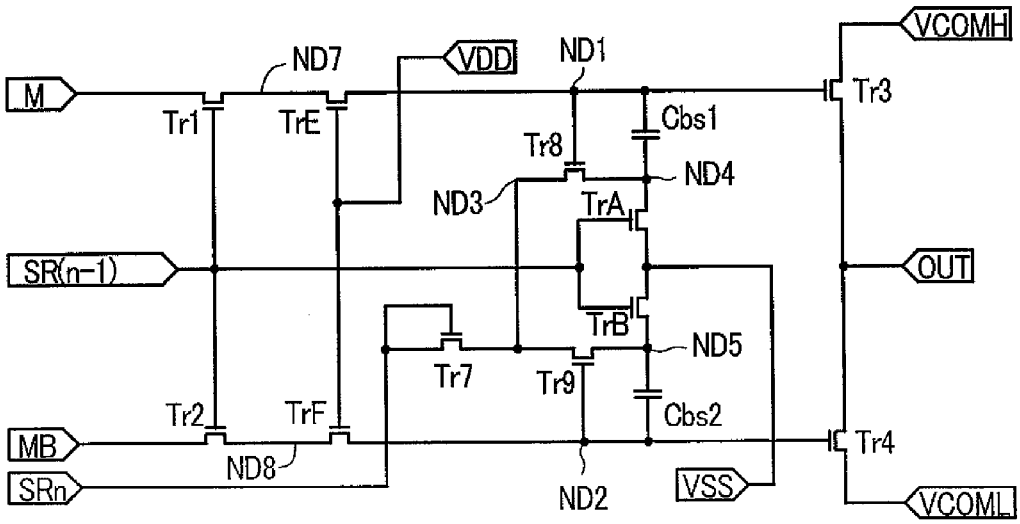
FIG. 12 is a circuit diagram showing a modification of the common electrode drive circuit shown in FIG. 8.

Accordingly, as shown in FIG. 12, a transistor (TrE) is connected between the drain of the transistor (Tr1) and the gate of the transistor (Tr3) and, in the same manner, a transistor (TrF) is connected between the drain of the transistor (Tr2) and the gate of the transistor (Tr4).

Then, a given voltage of VDD is applied to the gates of the transistors (TrE, TrF). Here, the voltage (VDD) is set to a voltage substantially equal to the H level of the scanning line selection signal. Further, it is possible to omit the transistor (TrF).

Due to such a constitution, even when the node (ND1) assumes a high voltage due to a bootstrap effect, for example, the node (ND7) only assumes a voltage (VDD-Vth) which is dropped from the voltage of VDD by the threshold value voltage (Vth) at maximum.

Accordingly, the voltage difference which is equal to or more than an amplitude of the AC signal (M, MB) or the scanning line selection signal is not generated also between the source and the drain of any transistor.

Here, when the common electrode drive circuit shown in FIG. 8 is combined with the transistor (Tr5) and the transistor (Tr6) shown in FIG. 7, by connecting the transistor (Tr5) and the transistor (Tr6) to the node (ND8) and the node (ND7) respectively, it is also possible to obtain the above-mentioned advantageous effects with respect to the transistor (Tr5) and the transistor (Tr6).

Figure 13:
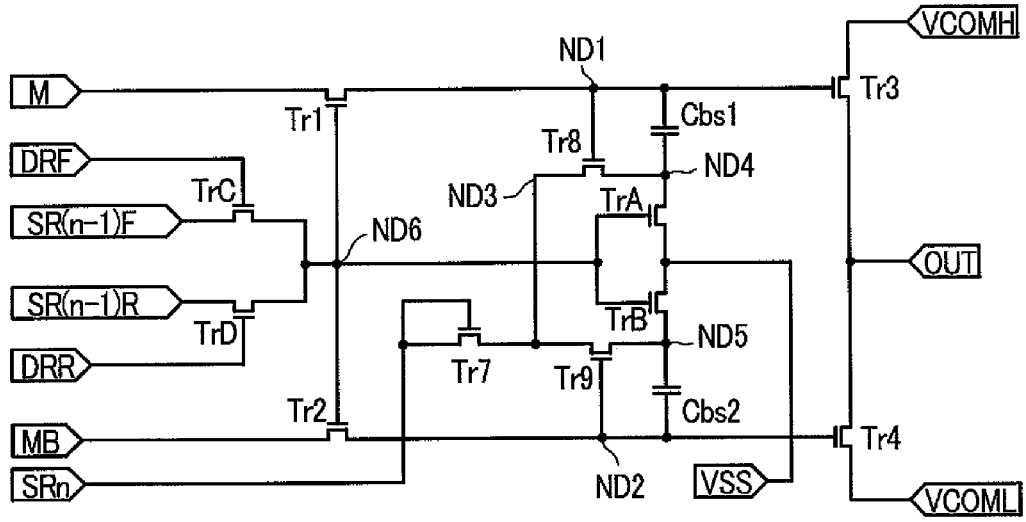
FIG. 13 is a circuit diagram showing a modification of the common electrode drive circuit shown in FIG. 8.

In the common electrode drive circuit shown in FIG. 8, by providing a directional control switch to the terminal to which the scanning line selection signal (SR(n−1)) of the preceding stage is supplied as shown in FIG. 13, it is possible to easily realize a double-way operation.

In the common electrode drive circuit shown in FIG. 13, assuming that scanning is performed in the normal direction as well as in the reverse direction, at the time of performing the normal-direction scanning, symbol SR(n−1)F indicates an output of the preceding stage of the nth scanning line selection signal (SRn) (an output of a succeeding stage at the time of performing the reverse-direction scanning) SR(n−1) while the symbol SR(n−1)R indicates an output of the succeeding stage of the nth scanning line selection signal (SRn) (an output of a preceding stage at the time of performing the reverse-direction scanning) SR(n+1).

The scanning line selection signals (SR(n−1) F, SR(n−1)R) are outputted from the scanning line drive circuit 10 shown in FIG. 3.

Further, at the time of performing the normal-direction scanning, by allowing the direction control signal (DRF) to assume the H level and the direction control signal (DRR) to assume the L level, the transistor (TrC) is turned on. Further, at the time of performing the reverse-direction scanning, by allowing the direction control signal (DRF) to assume the L level and the direction control signal (DRR) to assume the H level, the transistor (TrD) is turned on. Accordingly, the scanning selection signal of the preceding stage of the nth scanning line selection signal (SRn) is always inputted to the node (ND6) with respect to the scanning direction and hence, the double-way operation can be realized.

Here, it is preferable that the H level of the direction control signal (DRF, DRR) is set higher than the H level of the scanning line selection signal, and the L level of the direction control signal (DRF, DRR) is set lower than the L level of the scanning line selection signal.

In the common electrode drive circuit shown in FIG. 13, for example, when the scanning line selection signal (SR (n−1)F) assumes the H level at the time of performing the normal-direction scanning (the direction control signal (DRF) assuming the H level and the direction control signal (DRR) assuming the L level), the voltage of the node (ND6) is also elevated, and the transistor (TrC) assumes an OFF state at a voltage which is dropped from the H level of the direction control signal (DRF) by the threshold value voltage (Vth) and hence, the node (ND6) assumes a floating state.

Thereafter, for example, when the AC signal (M) assumes the H level (the AC signal (MB) assuming the L level), a bootstrap effect is obtained due to the gate capacitance of the transistor (Tr1) and hence, the voltage of the node (ND6) is elevated.

In this case, the elevating voltage is determined based on a ratio between the gate capacitance of the transistor (Tr1) and the load capacitance of the node (ND6) (the gate capacitance of the transistor (Tr2), the transistor (TrA) or the transistor (TrB), a gate-off capacitance of the transistor (TrD) or the like).

Accordingly, by decreasing the gate capacitance of the transistor (TrA) or the transistor (TrB) or the gate-off capacitance of the transistor (TrC) or the transistor (TrD) it is possible to obtain the further enhanced bootstrap effect.

Also in the common electrode drive circuit shown in FIG. 13, the voltages of the node (ND1) and the node (ND2) assume voltages which are higher than the H levels of the AC signals (M, MB) due to a bootstrap effect. Accordingly, the high voltage difference is generated between the source and the drain of the transistor (Tr1) and the transistor (Tr2) thus giving rise to a drawback with respect to a breakdown strength.

To overcome such a drawback, the above-mentioned circuit constitution shown in FIG. 12 may be adopted. With respect to the circuit constitution which can cope with the double-way operation, as shown in FIG. 14, it is also possible to make use of direction control signals.

Figure 14:
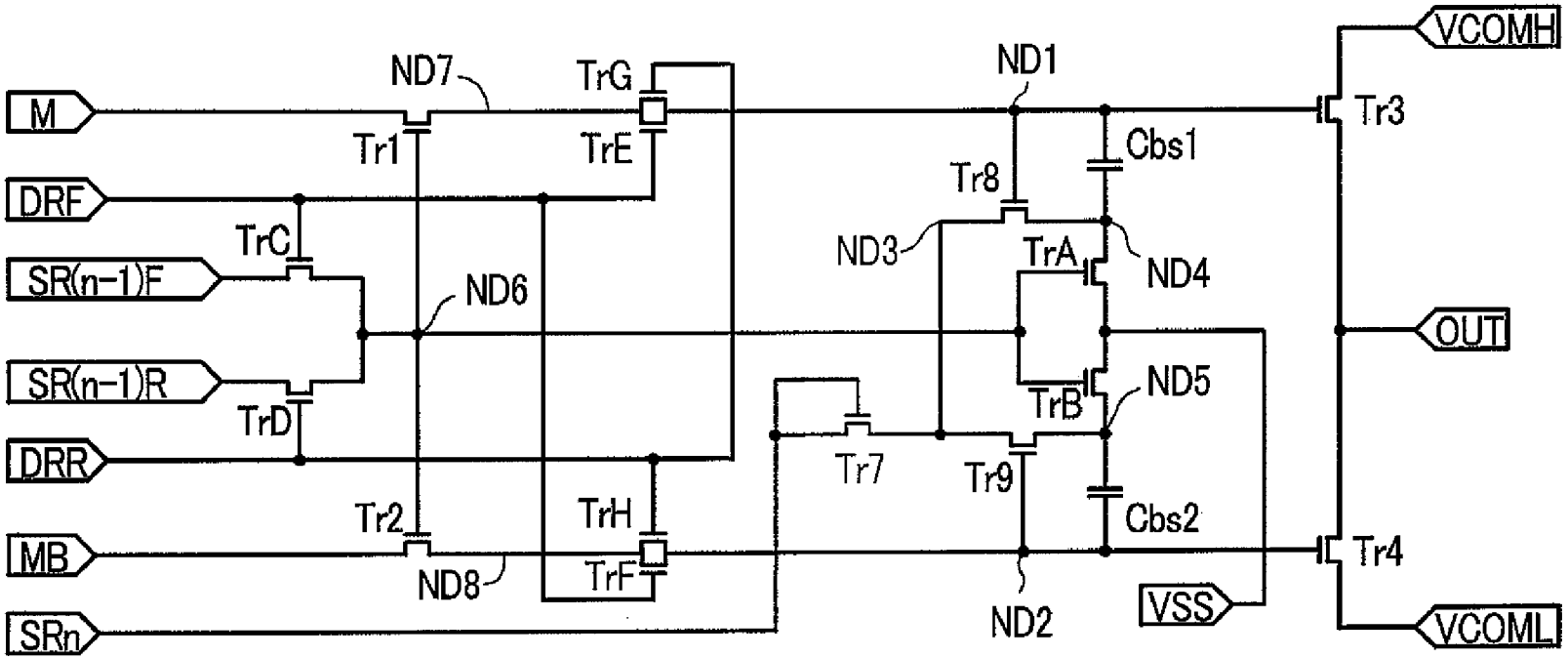
FIG. 14 is a circuit diagram showing a modification of the common electrode drive circuit shown in FIG. 13.

In the common electrode drive circuit shown in FIG. 14, a transistor (TrE) and a transistor (TrG) are connected between the drain of the transistor (Tr1) and the gate of the transistor (Tr3) and, in the same manner, a transistor (TrF) and a transistor (TrH) are connected between the drain of the transistor (Tr2) and the gate of the transistor (Tr4). Here, the transistors (TrF, TrH) may be omitted.

Further, the direction control signal (DRF) is applied to the gates of the transistors (TrE, TrF), while the direction control signal (DRR) is applied to the gates of the transistors (TrG, TrH).

Due to such a constitution, it is possible to prevent the generation of high voltage difference between the source and the drain of the transistor (Tr1) and the transistor (Tr2).

Here, in combining the common electrode drive circuit shown in FIG. 14 with the transistor (Tr5) and the transistor (Tr6) shown in FIG. 7, by connecting the transistor (Tr5) and the transistor (Tr6) to the node (ND8) and the node (ND7) respectively, it is also possible to obtain the above-mentioned advantageous effects with respect to the transistor (Tr5) and the transistor (Tr6).

Figure 15:
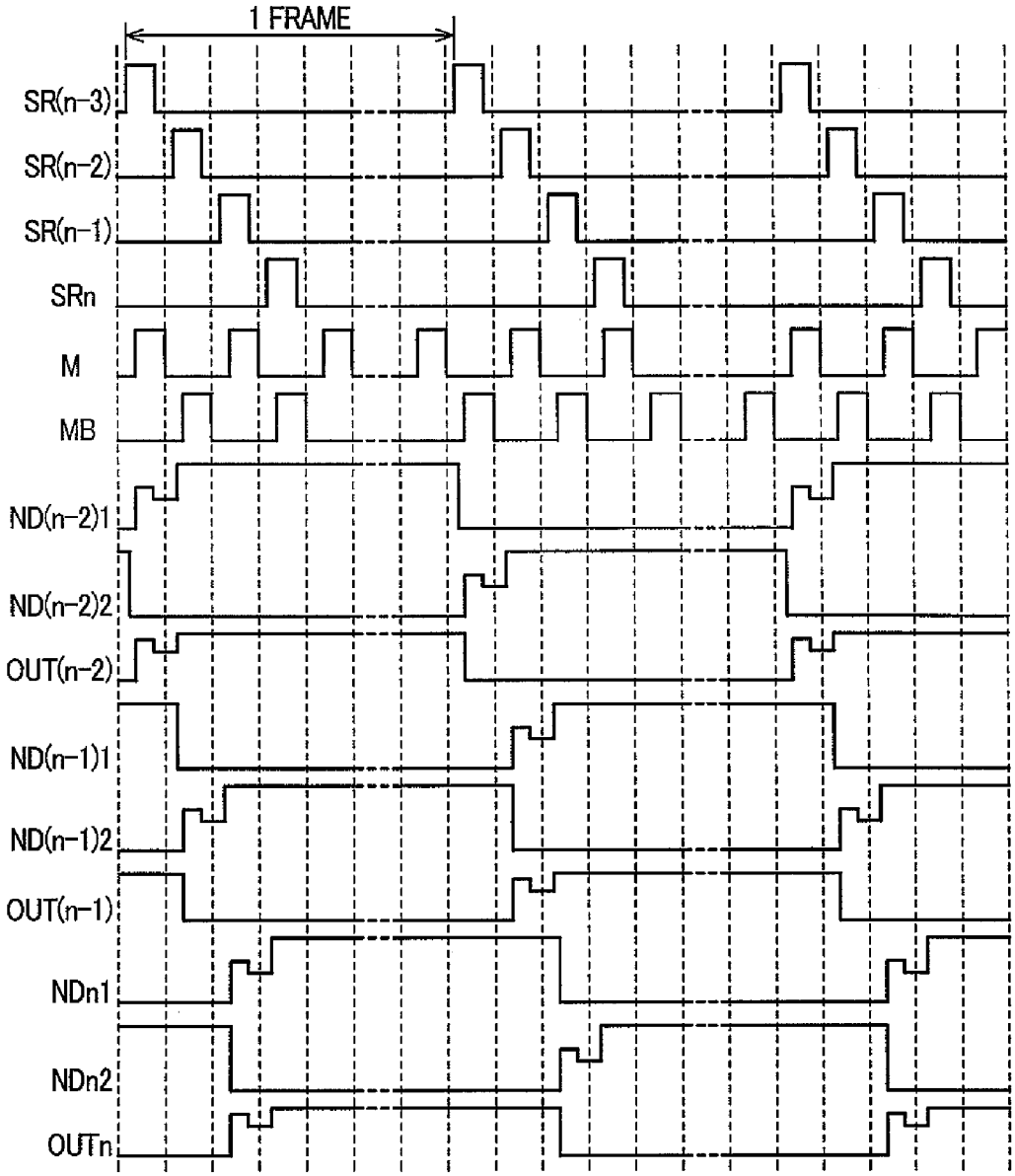
FIG. 15 is a timing chart when the common electrode drive circuit shown in FIG. 8 is provided for every common line and is driven by a line inversion driving method.
Figure 16:
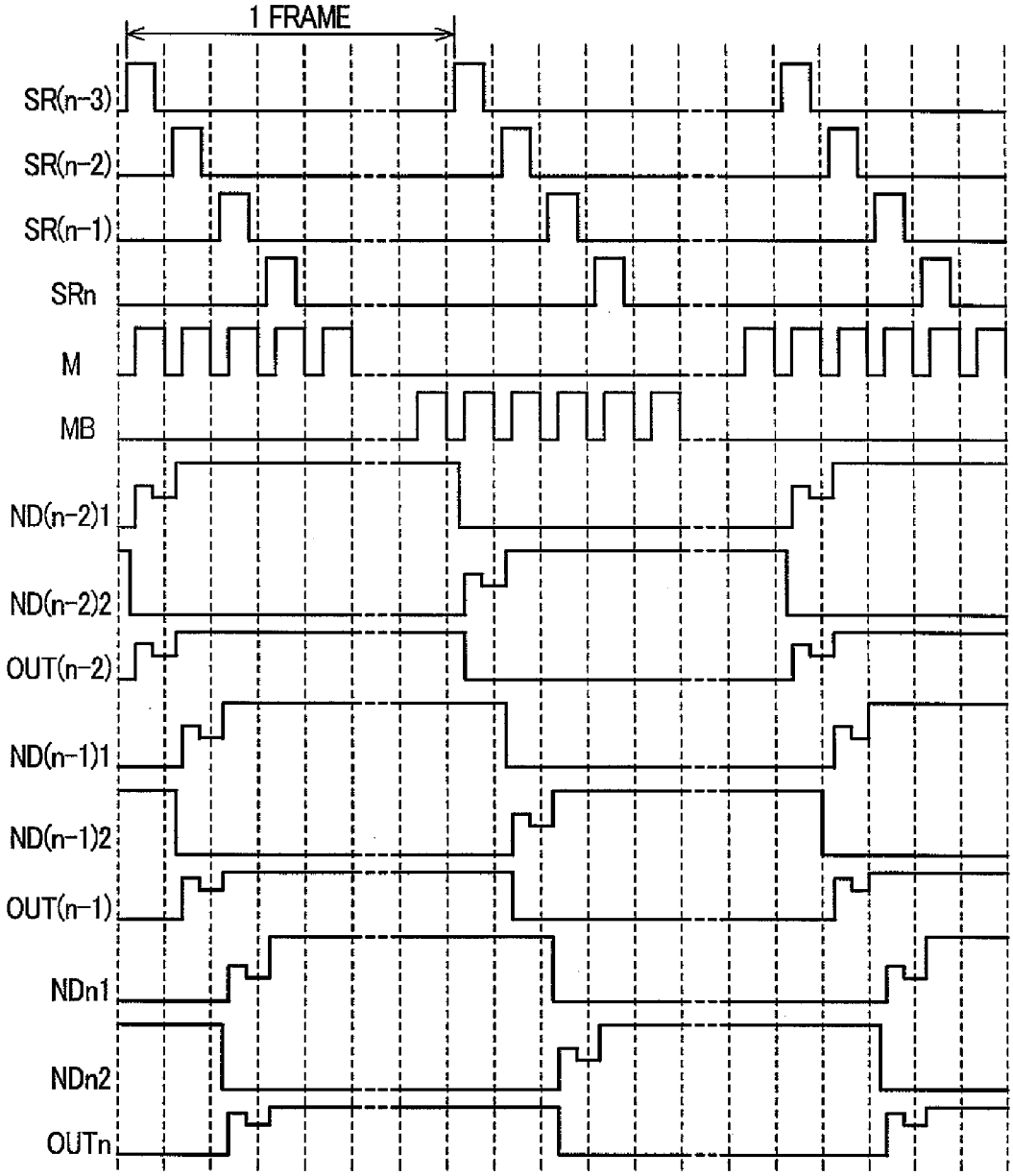
FIG. 16 is a timing chart when the common electrode drive circuit shown in FIG. 8 is provided for every common line and is driven by a frame inversion driving method.

When the common electrode drive circuit shown in FIG. 8 is provided to each common line, a timing chart of the line inversion driving becomes as shown in FIG. 15 and a timing chart of the frame inversion driving becomes as shown in FIG. 16.

As shown in FIG. 16, when the above-mentioned circuit constitution is adopted, it is understood that, depending on the frame, the frequency of the AC signal (M, MB) becomes twice as large as the frequency of the case in which the line inversion driving is adopted.

Figure 17:
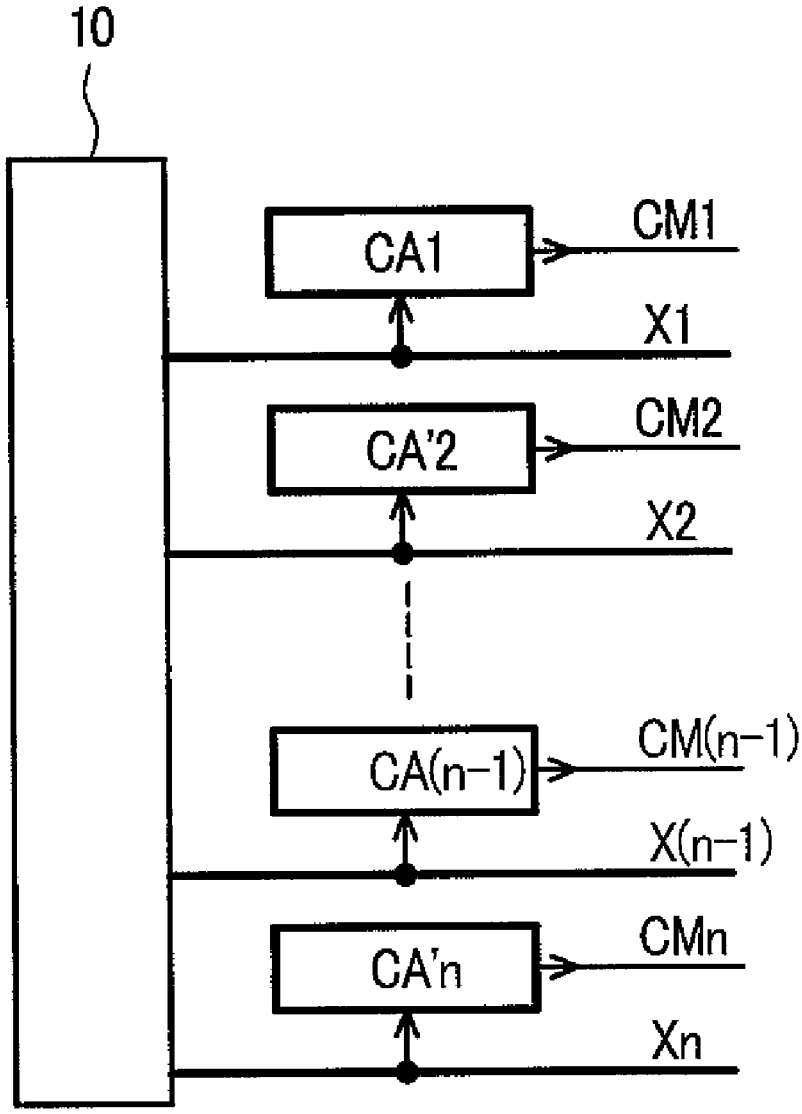
FIG. 17 is a block diagram showing a modification of the common electrode drive circuit when the common electrode drive circuit shown in FIG. 8 is provided for every common line and is driven by a frame inversion driving method.
Figure 18:
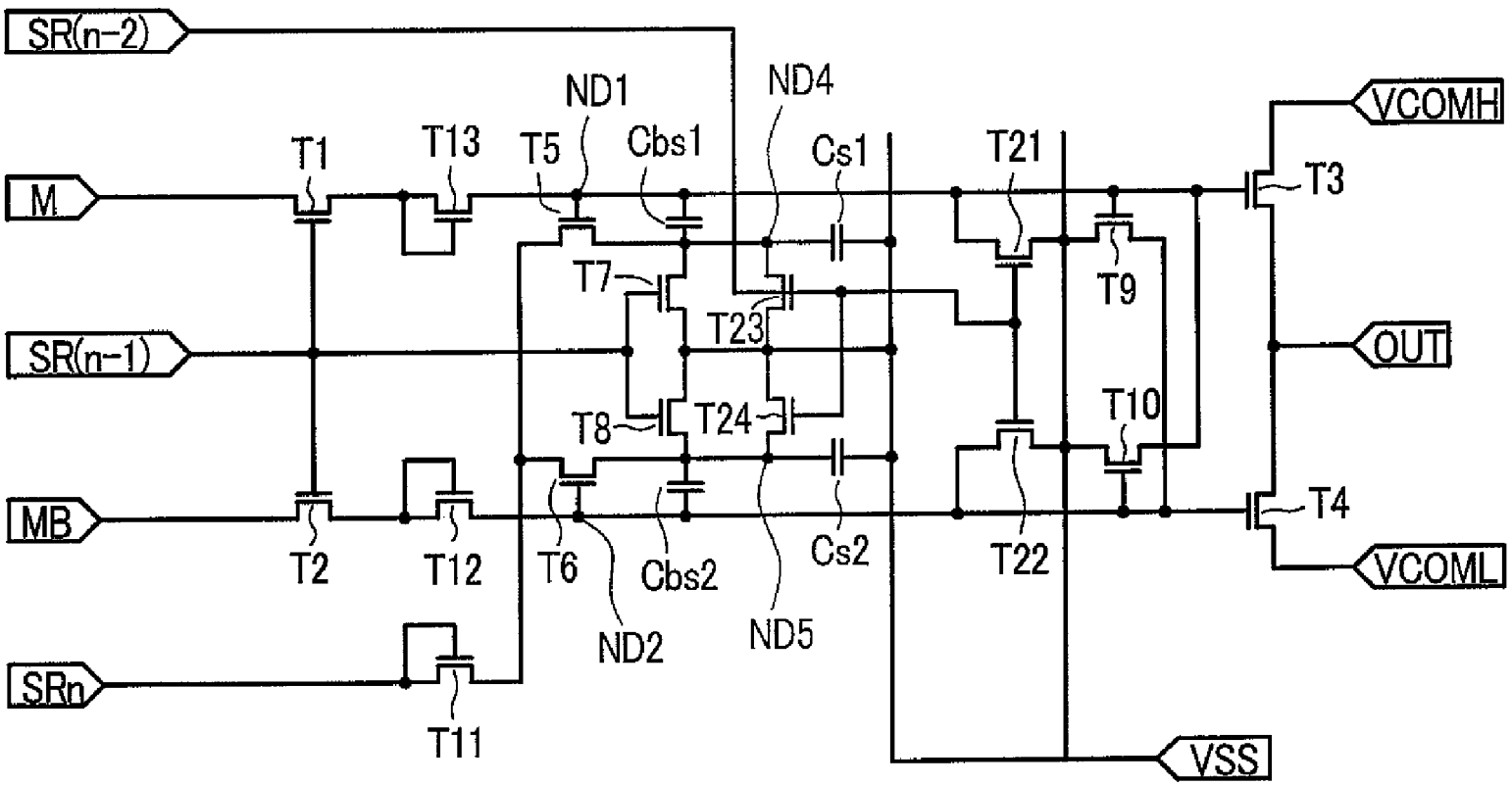
FIG. 18 is a circuit diagram showing a common electrode drive circuit having the single channel circuit constitution for driving by an every-line independent common AC driving method which is conceived by inventors of the present invention before the invention.
Figure 19:
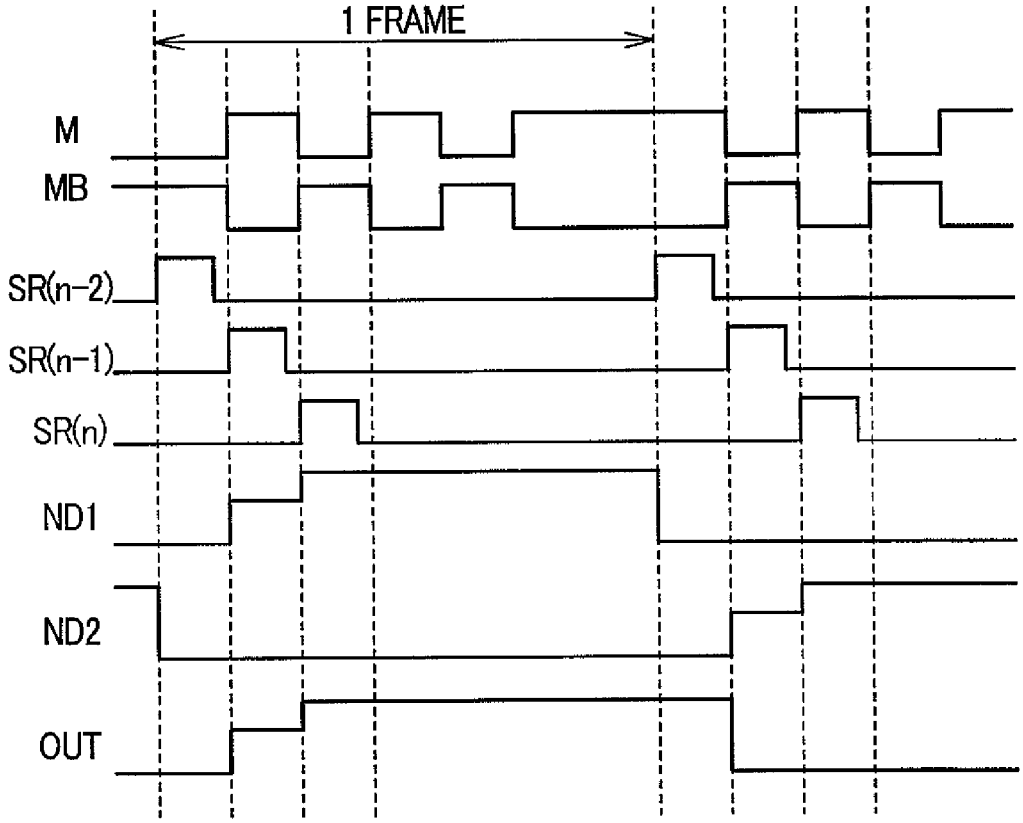
FIG. 19 is a timing chart of the common electrode drive circuit shown in FIG. 18.

Accordingly, by assuming the common electrode drive circuit shown in FIG. 8 as CA and a circuit in which the terminal to which the AC signal (M) is applied and the terminal to which the AC signal (MB) is applied are exchanged with respect to the common electrode drive circuit shown in FIG. 8 (the circuit being equivalent to a circuit in which the common voltage (VCOMH) of the positive polarity and the common voltage (VCOML) of the negative polarity are exchanged) as CA', and by providing CA and CA' alternately (n being an even number) as shown in FIG. 17, for example, it is possible to perform the frame inversion driving at the timing of the AC signals (M, MB) shown in FIG. 15. Here, although CA are arranged at odd-numbered stages and CA' are arranged at even-numbered stages, it is needless to say that CA and CA' are arranged in an opposite manner.

Here, although the explanation has been made with respect to the case in which the common electrode drive circuit is constituted of the n-type thin film transistors heretofore, the present invention is not limited to the MOS single channel constitution constituted of the n-type thin film transistors and may be also formed of the pMOS single channel which is formed of p-type thin film transistors. In this case, the reference voltage of VSS assumes the H level and the logic is inverted.

Here, the common voltages (VCOMH, VCOML) are applied to the counter electrodes formed in the inside of the pixels. In this specification, "the positive polarity" of the common voltage (VCOMH) of the positive polarity implies that the common voltage is on a higher potential side than a voltage applied to the pixel electrodes and is irrelevant to whether the common voltage (VCOMH) is larger or smaller than 0V. In the same manner, "the negative polarity" of the common voltage (VCOML) of the negative polarity implies that the common voltage is on a lower potential side than the voltage applied to the pixel electrodes and is irrelevant to whether the common voltage (VCOML) is larger or smaller than 0V.

As has been explained heretofore, according to the embodiment, since the circuit can be constituted of either the n-type single channel elements or the p-type single channel elements, the manufacturing process can be shortened. Further, the double-way operation can be performed with one circuit. Still further, due to the reduction of the number of elements (transistors) and the signal paths, the circuit scale can be miniaturized thus enhancing a yield rate.

Here, in the above-mentioned description, although the explanation has been made with respect to the case in which the MOS (Metal Oxide Semiconductor) type TFTs are used as transistors, generally available MOS-FET or MIS (Metal Insulator Semiconductor) type FETs or the like can be also used.

Further, in the above-mentioned description, the explanation has been made with respect to the embodiments in which the present invention is applied to the liquid crystal display device. It is needless to say that, however, the present invention is not limited to such embodiments and is applicable to an EL display device which uses organic EL elements or the like, for example.

Although the invention which is made by the inventors of the present invention has been specifically explained based on the above-mentioned embodiments heretofore, it is needless to say that the present invention is not limited to the above-mentioned embodiments and various modifications can be made without departing from the gist of the present invention.

What is claimed is:

1. A display device comprising:

a plurality of pixels; and a common electrode drive circuit, the common electrode drive circuit including a plurality of basic circuits, wherein the basic circuit comprises:

a first circuit which latches a first input signal at a point of time that a clock signal is changed to a first voltage level from a second voltage level;

a second circuit which latches a second input signal at the point of time that the clock signal is changed to the first voltage level from the second voltage level;

a first switching circuit which is turned on based on the voltage latched by the first circuit and outputs a first power source voltage to an output terminal in an ON state; and a second switching circuit which is turned on based on the voltage which is latched by the second circuit and outputs a second power source voltage to an output terminal in an ON state, wherein when the first input signal assumes the second voltage level, the second input signal assumes the first voltage level, and when the second input signal assumes the second voltage level, the first input signal assumes the first voltage level, and after the clock signal is changed to the second voltage level from the first voltage level and before the clock signal returns to the first voltage level from the second voltage level, either one of the first input signal and the second input signal is changed to the second voltage level from the first voltage level.

2. A display device comprising:

a plurality of pixels; and a common electrode drive circuit, the common electrode drive circuit including a plurality of basic circuits, wherein the basic circuit comprises:

a first transistor which has a first electrode to which a first input signal is applied and a control electrode to which a clock signal is applied;

a second transistor which has a first electrode to which a second input signal is applied and a control electrode which is connected to the control electrode of the first transistor;

a third transistor which has a control electrode which is connected to a second electrode of the first transistor, a first electrode which is connected to an output terminal, and a second electrode to which a first power source voltage is applied; and a fourth transistor which has a control electrode which is connected to a second electrode of the second transistor, a second electrode which is connected to the output terminal, and a first electrode to which a second power source voltage is applied; wherein after the clock signal is changed to a second voltage level at which the first and second transistors are turned on from a first voltage level and, at the same time, before the clock signal returns to the first voltage level from the second voltage level, one input signal out of the first input signal and the second input signal is changed to the second voltage level from the first voltage level, and when the first input signal is at the second voltage level, the second input signal assumes the first voltage level and when the second input signal is at the second voltage level, the first input signal assumes the first voltage level.

3. A display device according to claim 2, wherein the basic circuit includes:

a first capacitive element which is connected between the second electrode of the first transistor and a reference power source line to which a reference voltage is supplied; and a second capacitive element which is connected between the second electrode of the second transistor and the reference power source line.

4. A display device according to claim 2, wherein the basic circuit includes:

a fifth transistor which has a control electrode which is connected to the second electrode of the first transistor, a second electrode which is connected to the second electrode of the second transistor, and a first electrode which is connected to a reference power source line to which a reference voltage is supplied; and a sixth transistor which has a control electrode which is connected to the second electrode of the second transistor, a second electrode which is connected to the second electrode of the first transistor, and a first electrode which is connected to the reference power source line.

* * * * *